US006119554A

United States Patent [19]

Plankenhorn

[11] Patent Number: 6,119,554

[45] Date of Patent: Sep. 19, 2000

[54] DEVICE FOR SHARPENING BLADES

[76] Inventor: Wolfgang Plankenhorn, Gartenstrasse 19, Ebhausen D-72224, Germany

[21] Appl. No.: 09/214,659

[22] PCT Filed: Jul. 11, 1997

[86] PCT No.: PCT/DE97/01467

§ 371 Date: May 17, 1999

§ 102(e) Date: May 17, 1999

[87] PCT Pub. No.: WO98/02280

PCT Pub. Date: Jan. 22, 1998

[30] Foreign Application Priority Data

Jul. 11, 1996 [DE] Germany ..... 196 27 813

[51] Int. Cl.[7] ..... B24D 15/06

[52] U.S. Cl. ..... 76/82

[58] Field of Search ..... 76/82–86, 88–89

[56] References Cited

U.S. PATENT DOCUMENTS

| | | | |
|---|---|---|---|
| 289,919 | 12/1883 | Lewis | 76/86 |
| 4,731,957 | 3/1988 | Weisinger . | |
| 5,377,563 | 1/1995 | Weeks | 76/86 |

FOREIGN PATENT DOCUMENTS

| | | |
|---|---|---|
| 66 08 850 | 3/1968 | Germany . |
| 68 05 452 | 2/1969 | Germany . |
| 35 04 296 | 8/1986 | Germany . |
| 40 02 758 | 8/1991 | Germany . |
| 93 06 427 | 9/1993 | Germany . |
| 463 995 | 11/1968 | Switzerland . |

*Primary Examiner*—Douglas D. Watts

[57] ABSTRACT

A device for sharpening blades has a hard metal cutting blade (7) per se known in the art, secured to an ergonomically shaped handle (1). A bead (6) is provided to reduce the risk of accidents.

6 Claims, 1 Drawing Sheet

DEVICE FOR SHARPENING BLADES

BACKGROUND OF THE INVENTION

The invention concerns a device for sharpening blades on knives, scissors and the like with a handle at one end of which a hard metal tool is disposed and with a protective bead disposed between the hard metal tool and the handle. The sharpening of knives or the like using hard metals has been known in the art for some time. Instead of hard metals, ceramic materials are also utilized having a hardness similar to that of hard metal, however, being more brittle. Since sintered materials such as hard metal or ceramic are very expensive, only relatively small sintered material cutting plates are used in the sharpening devices and must be clamped in a holding device. Mass produced cutting plates made from sintered material are utilized for milling tools, lathe tools and the like. The sharpening of blades on cutting devices such as knives, scissors, scythes and the like has, up to this point in time, been effected using whetting rods or devices (EP 0431273) having a wedge-shaped gap at which a plurality of rounded grinding elements are disposed. In the latter, the blade to be sharpened is inserted into the wedge-shaped gap and guided past the grinding elements in the cutting direction. Such a "knife sharpening device" can normally only be used for a limited size range of knives and cutting devices. In addition, the differing diagonal slanting of the blades associated with differing cutting types is fixed with such knife sharpening devices and cannot be changed.

Also known in the art is a knife sharpener (DE G 93 06 427.6) with which a hard metallic tool is molded onto a plastic handle. A peripheral bead is provided between the hard metal tool and the handle for reducing risk of injury. Such a knife sharpener has the disadvantage that the hard metal tool cannot be detached from the handle. In addition, the geometry of the hard metal tool leads to a cramped working posture.

SUMMARY OF THE INVENTION

The device for sharpening of blades in accordance with the invention and mass produced cutting plates manufactured for other applications e.g. for milling operations, constituting the hard metal tool, and with a tool receptacle for mounting the cutting plate disposed on one end of the handle, wherein the hard metal cutting plate can be bolted to the tool receptacle, has, in contrast thereto, the advantage that a hard metal cutting plate, mass produced and therefore inexpensive, is utilized as a hard metal tool and this hard metal cutting plate is mounted in a replaceable fashion in an associated tool receptacle having a handle so that a dull hard metal cutting plate can be easily replaced and the most differing of blades can be sharpened with one tool. In addition, the choice of blades can improve working posture.

In accordance with an advantageous configuration of the invention, the handle is ergonomically configured to facilitate easy use.

In accordance with an additional advantageous configuration of the invention, the longitudinal cross section through the cutting plate is radially symmetric (rhombic, rectangular, square, triangular) and the mounting bore is disposed in the center of the cutting plate so that the plate can be mounted at a plurality of positions on the holding device to allow sequential use of the plurality of cutting surfaces of the cutting plate.

In accordance with an additional advantageous configuration of the invention, a coated (TiN) hard metal cutting plate is utilized to increase the endurance.

In accordance with an additional advantageous configuration of the invention, a bore is provided for in the holding device to facilitate hanging and for orientation with regard to the rotational position of the holding device so that the device is not damaged and the user directly feels the rotational position of the device when the device is held in his hand.

In accordance with an advantageous application of the invention, the device is utilized for burr removal so that burrs can be removed in a simple and secure fashion.

Further advantages and advantageous configurations of the invention can be extracted from the subsequent description, the drawing and the claims.

BRIEF DESCRIPTION OF THE DRAWING

An embodiment of the invention is more closely described in the drawing as a device for sharpening blades having a detachable hard metal cutting plate.

Figure 1:
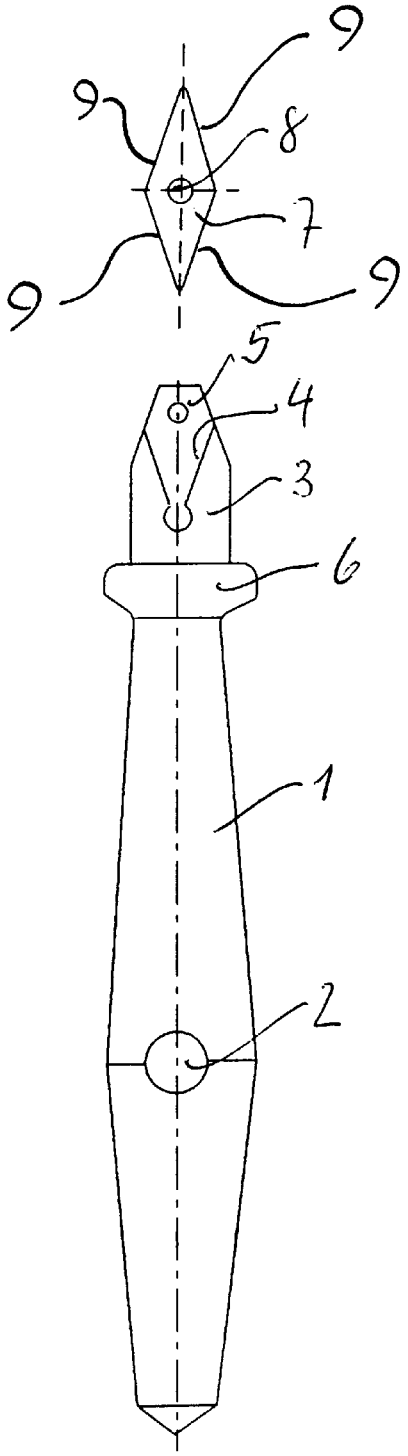
FIG. 1 shows an exploded view of a blade sharpening device. A tool receptacle 3 having a wedge-shaped recess 4 comprising a sideward bordering wall is disposed on a handle 1 having a transverse bore 2. A bead 6 is provided between the tool receptacle 3 and the handle 1 to prevent injury when the cutting device slips. A hard metal cutting plate 7 can be inserted into the tool receptacle 3 or into the recess 4 having a rhombic longitudinal cross section and a central bore 8 for firmly bolting the hard metal cutting plate to the support surface of the recess 5 using a bolt (not shown). Due to the radial symmetry of the cutting plate 7 with respect to the central bore 8, the cutting plate 7 can be mounted in two positions so that all four cutting edges 9 thereof can be used.

The sharpening of blades is effected by guiding a cutting edge 9 of a cutting plate 7, mounted in the tool receptacle 3, over the cutting surface or the longitudinal surface of a cutting device to thereby effect material removal by scraping or cutting. The cutting surface joins the two longitudinal surfaces, disposed parallel or with a wedge shape with respect to each other. The cutting surface and one of the longitudinal surfaces form the cutting edge of the blade.

All the features represented in the description, the subsequent claims and the drawing can be important to the invention individually or in arbitrary combination.

List of Reference Symbols

1 handle
2 transverse bore
3 tool receptacle
4 recess
5 recess support surface
6 bead
7 cutting plate
8 central bore
9 cutting edge

What is claimed is:

1. A device for sharpening blades, the device comprising:

one single cutting plate having a first plate end with a first cutting surface, a second cutting surface and a first tip disposed between said first and said second cutting surfaces, said cutting plate having a second plate end with a third cutting surface, a fourth cutting surface and a second tip disposed between said third and said fourth cutting surfaces, said cutting plate having a radially symmetric longitudinal cross section and a hole disposed in a center of said cutting plate;

a handle having a longitudinal axis;

a head having a recess at a first head end for accepting said second plate end, said recess and said first head end terminating at a longitudinal separation from said first tip to allow simultaneous free external access to said first and said second cutting surfaces;

a protective bead disposed between and integral with said handle and a second end of said head; and means for bolting said cutting plate, through said hole, to said head.

2. The device of claim 1, wherein said handle is shaped for easy handling.

3. The device of claim 1, where said longitudinal cross section is one of rhombic, rectangular, quadradic and triangular.

4. The device of claim 1, wherein said cutting plate is coated.

5. The device of claim 1, wherein said handle has a through hole to facilitate hanging and for rotational orientation of said handle.

6. The device of claim 1, wherein at least one of said handle, said head and said cutting plate comprise means for burr removal.

* * * * *